US006959885B2

(12) United States Patent
King

(10) Patent No.: US 6,959,885 B2
(45) Date of Patent: Nov. 1, 2005

(54) CENTER-FEED ROLL AND METHOD OF MAKING THEREOF

(75) Inventor: Timothy James King, Carnforth (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 123 days.

(21) Appl. No.: 10/675,839

(22) Filed: Sep. 30, 2003

(65) Prior Publication Data

US 2005/0067519 A1 Mar. 31, 2005

(51) Int. Cl.[7] ..... B65H 18/08; B65H 18/28

(52) U.S. Cl. ..... 242/160.2; 242/160.4; 242/526.1; 242/530.2; 242/593

(58) Field of Search ..... 242/160.1, 160.2, 242/160.4, 526.1, 530.2, 593, 899; 206/389, 390, 391

(56) References Cited

U.S. PATENT DOCUMENTS

| | | | | |
|---|---|---|---|---|
| 400,913 | A | * | 4/1889 | Hicks ..... 242/160.2 |
| 3,877,576 | A | | 4/1975 | Kishi et al. |
| 5,048,589 | A | | 9/1991 | Cook et al. |
| 5,399,412 | A | | 3/1995 | Sudall et al. |
| 5,543,202 | A | | 8/1996 | Clark et al. |
| 6,145,782 | A | | 11/2000 | King et al. |
| 6,245,273 | B1 | | 6/2001 | Wendler, Jr. |

FOREIGN PATENT DOCUMENTS

| | | |
|---|---|---|
| EP | 0865247 B1 | 3/2002 |
| WO | WO 99/18835 | 4/1999 |
| WO | WO 00/11998 | 3/2000 |

* cited by examiner

*Primary Examiner*—John M. Jillions
(74) *Attorney, Agent, or Firm*—Richard M. Shane

(57) ABSTRACT

A double-wound center-feed roll is disclosed which is formed from at least two webs each having lines of weakness which allow the webs to be separated into a plurality of sheets. The lines of weakness of one web are offset from those of the other such that in use the sheets can be dispensed singly from alternate webs. A first portion of the webs at the center of the roll is lightly bonded together while a second portion of the webs on the outside of the roll remains unbonded. The center-feed roll of the present invention reduces the occurrence of both web orientation reversal and streaming dispensing problems.

20 Claims, 3 Drawing Sheets

CENTER-FEED ROLL AND METHOD OF MAKING THEREOF

BACKGROUND OF THE INVENTION

Center-feed rolls that consist of webs of paper, nonwoven, or other sheet-like materials which are perforated such that the webs can be separated into individual sheets are well-known to those skilled in the art. The roll is often installed in a dispenser with the axis of the roll being vertical, and the sheet-like material is fed from the center of the roll out of the dispenser through an aperture, usually in the base of the dispenser. This type of roll and dispenser is often found in public restrooms, gas station pump areas, and in hospitals and industry, either for use as a dispenser for hand towels or for tissues or towels for general cleaning use.

EP-0865247-B1 to King discloses a double-wound center-feed roll and a dispenser for supporting the roll having an aperture and a base in the dispenser which is provided with a rim which projects into the center of the roll in use. It describes a center-feed roll formed from two webs each having lines of weakness which allow the webs to be separated into a plurality of individual sheets. The lines of weakness of one web are offset from those of the other such that in use the sheets can be dispensed singly from alternate webs. Thus, it provides a double-wound center-feed roll which allows single-sheet dispensing. In use, both webs feed through the aperture of the dispenser, with one web protruding further than the other due to the offset lines of weakness. A user grips and pulls the outermost web, and the friction between it and the aperture causes the next line of weakness in that web to break when it is at or near the aperture such that a single sheet is dispensed. As one web is being pulled from the dispenser and a sheet detached, the other web is also being drawn out from the dispenser. Because the lines of weakness are offset, when the line of weakness of one web breaks, the first sheet of the next web is already protruding from the dispenser. Thus, a well-presented and untouched sheet is available for the next user.

Dispensing performance of the above-described double-wound center-feed roll can be impaired if the orientation of the dispensing webs is reversed. Double-wound center feed rolls are made, as described above, with an inner web and an outer web. The inner web is positioned directly adjacent to the core or the center of the roll. The outer web is separated from the core or center of the roll by the inner web. Web orientation reversal occurs when one complete circumference of the inner web is removed without removing any portion of the outer web. When this occurs, the inner web becomes the outer web and the outer web becomes the inner web.

Web orientation reversal impairs dispensing performance because it can change the relationship of the offset perforations between the inner and the outer webs. When the inner web and the outer web are maintained in the proper relationship, i.e., the inner web remains the inner web and the outer web remains the outer web, the perforations in the inner and outer webs are offset. If the webs reverse, the perforations of the new inner and new outer webs may not have the proper spacing with respect to one another and dispensing may become more difficult or stop altogether.

One method of reducing the incidence of web orientation reversal is to lightly crimp the inner web to the outer web prior to winding the inner and outer web into a roll. Processes for lightly crimping layers together are known in the art. Lightly crimping the inner and outer layers associates the layers together making it less likely for a user to reverse the two layers. However, the light crimping increases the dispensing force required to separate one web from the other and is likely to increase the incidence of streaming, a dispensing problem that occurs when an individual sheet fails to separate, but rather, continues to pull an excessively long section of attached sheets from the dispenser.

Therefore, there is a need for a double-wound center-feed roll in which single sheets can be dispensed with both reduced opportunity for reversal of the inner and outer webs and reduced incidence of streaming. Additionally, there is a need for a process for manufacturing the same.

SUMMARY OF THE INVENTION

The aforesaid needs are fulfilled and the problems experienced by those skilled in the art overcome by the double-wound center-feed roll of the present invention. In one embodiment, the double-wound center-feed roll of the present invention includes at least two webs having regularly spaced lines of weakness. The lines of weakness of the first web are offset from the lines of weakness of the second web. A first portion of the first and second webs at the center of the roll is bonded to form a bond between the first and second webs, while a second portion of the first and second webs remains unbonded. In one aspect, the bond comprises a crimped bond.

In one embodiment, the length of the bonded portion of the first and second webs is from about 1 meter to about 2 meters. In another embodiment, the length of the bonded portion of the first and second webs is less than about 1% of the entire length of the webs. In a further embodiment, the second portion of the two webs extends to the outside surface of the roll.

In one embodiment, the attachment strength between the webs in the first portion is less than about 20% of the tensile strength of the webs. In another embodiment, the attachment strength between the webs in the first portion is greater than about 200 grams. In a further embodiment, the strength of the lines of weakness is less than about 20% of the tensile strength of the webs.

The lines of weakness across the width of the webs are desirably defined by perforations across the width of the webs. Desirably, the width of the individual perforations is greater than about 1 mm. Further, each web desirably has less than about 15 perforations per 10 cm width of the roll.

Desirably, the offset ratio of the perforations of the first web to those of the second web is less than about 70/30. Even more desirably, the offset ratio is about 50/50, such that each sheet is presented in an amount equal to that of the previous and the subsequent sheets.

In another aspect of the invention, a method is provided for making a double-wound center-feed roll. The method includes the steps of a) providing at least a first web and a second web; b) perforating the first and second webs to form first and second webs having regularly spaced lines of weakness; c) offsetting the lines of weakness to form first and second webs having regularly spaced offset lines of weakness; d) simultaneously winding the first and second webs having regularly spaced offset lines of weakness to form a roll; e) activating a bonder at the start of the formation of the roll wherein a first portion of the first and second webs is bonded to form a bond between the first and second webs at the center of the roll; and, f) deactivating the bonder prior to completion of the roll wherein a second portion of the first and second webs remains unbonded.

In one embodiment, the bonder comprises a crimping wheel which remains in contact with the webs during the entire winding of the roll. Desirably, the crimping wheel rotates during the entire winding of the roll.

Other features and aspects of the present invention are discussed in greater detail below.

BRIEF DESCRIPTION OF THE DRAWINGS

Embodiments of the invention will now be described by way of example only and with reference to the accompanying drawings, in which.

DETAILED DESCRIPTION

The aforesaid needs are fulfilled and the problems experienced by those skilled in the art overcome by the double-wound center-feed roll of the present invention. The double-wound center-feed roll is comprised of two adjacent webs simultaneously wound to form a substantially cylindrical roll of material. As a consequence of being wound together, the two adjacent webs are positioned as inner and outer webs within the center-feed roll. The inner web starts directly adjacent to the core or the center of the roll. The outer web is separated from the core or center of the roll by the inner web.

The webs for which the present invention is suitable desirably have a series of regularly spaced zones or lines of weakness, each of which extend substantially across the width of the web. The zones of weakness are used to separate the web into individual sheets and may be, for example, defined by a series of perforations. Desirably, the zones of weakness in the adjacent inner and outer layers are offset. Double-wound webs having offset zones of weakness allow one web to tear at the zone of weakness as it is withdrawn from the roll while the following sheet still provides a tail of sheet material extending from the roll to be grasped by the next patron. The zones of weakness may be at any angle across the web relative to the edge of the web. Desirably the lines of weakness are perpendicular to the edge of the web.

Figure 1:
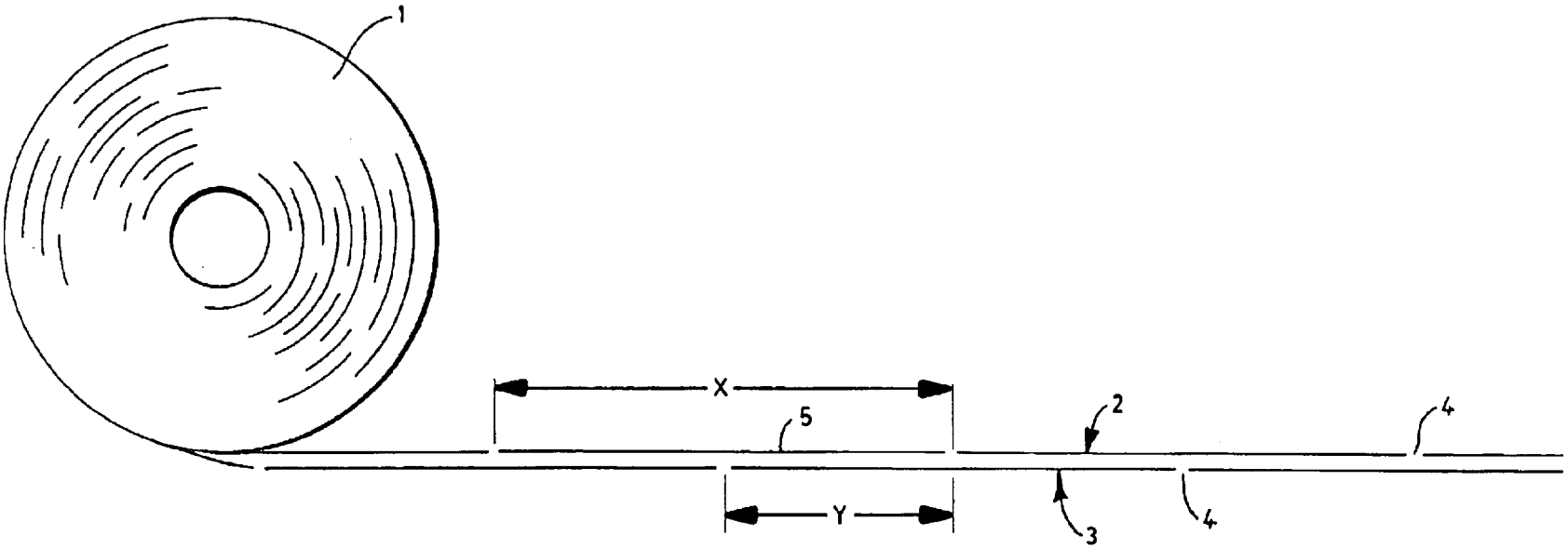
FIG. 1 shows a plan view of a center-feed roll according to the present invention.

FIG. 1 shows a center-feed roll 1 that has been unwound slightly from its outer surface to show the offset perforation arrangement. It should be understood that in use, the webs will be fed out from the inner surface, and the webs on the outer surface may be secured to one another so that the roll does not unwind as shown in the figure.

The center-feed roll 1 comprises an inner web 2 and an outer web 3 each having perforations 4 which allow individual sheets 5 to be detached from the webs. The individual sheets have a length X. The offset of the perforations is shown as length Y, and in this embodiment has an offset of about 50/50.

It is envisioned that any suitable amount of offset may be used for the webs. The offset can be expressed in terms of a ratio of percentages; the ratio must total 100, the sum of both lengths totaling the whole length of one sheet. Desirably, the offset ratio is less than about 70/30, and more desirably the ratio is less than about 60/40. Even more desirably, the offset is about 50/50, with each sheet being presented in an amount equal to that of the previous and the subsequent sheets. However, any offset in the range between about 50/50 and about 70/30 has been found to work adequately.

If there is an uneven offset present, it is desirable that the outer web projects more once a sheet has been detached from the inner web than the inner web projects when a sheet has been detached from the outer web. When the outer web is pulled from the roll, it will almost certainly pull the inner one with it because of the way the webs are wound up. Conversely, when the inner web is pulled, the certainty that the outer web will be pulled out is less because the inner web does not surround the outer web; more reliance is placed on the friction or other attachment between the two webs to pull the outer web out. Therefore, it is desirable that the outer web projects by a greater amount than the inner web each time so that there is more chance that the outer web will be drawn down with the inner web.

The present invention is suitable for any type of material which can be formed into a web, perforated, bonded together and rolled. For example, the web may be formed from paper, nonwoven or film, and may be natural or synthetic. Additionally, the webs may be single-ply or may consist of more than one ply. The webs are desirably made from paper and are desirably suitable for use as hand towels or other wipers. However, because there is less waste with the present invention (individual sheets are dispensed singly and cleanly, and do not rope), the invention can also be applied to dispense more costly materials. Examples of more expensive materials which can be dispensed in this system are Hydroknit® nonwoven fabric (a hydraulically entangled nonwoven fabric having high strength and abrasion resistance manufactured by Kimberly-Clark Corporation) and Kimtex® nonwoven fabric (a synthetic thermoplastic fiber fabric for use in industry and other areas, also manufactured by Kimberly-Clark Corporation).

The present invention will have applications in many fields. For example, the center-feed roll of the present invention may be used for sanitary applications such as hand towels and wipes, impregnated wipes, toilet tissue, kitchen towel and facial tissues, but may also be used in other applications where a single-sheet dispensing system is advantageous. For example, other applications may be dispensers for foil or cling-film, bags such as those found in supermarkets, and so forth.

The double-wound center-feed rolls of the present invention may be dispensed from standard center-feed roll dispensing systems. An exemplary center-feed roll dispensing system may include a center-feed roll as described herein, and a dispenser for supporting the roll and having an aperture therein through which the webs can pass from the inner surface of the roll. In such a system, force required to separate individual sheets from each web is selected such that the separated sheets can be withdrawn from the center of the roll but are subsequently separated as a result of the resistance provided adjacent or within the aperture. Exemplary dispensers and dispensing systems are described in EP-0865247-B1 to King.

Though it is envisioned that the center-feed roll will dispense with its axis in any orientation, the axis is desirably vertical such that the webs are dispensed from either the top end or the bottom end of the roll. Desirably, the webs are dispensed from the bottom end of the roll as this allows the webs to hang down and be more readily graspable.

It is envisioned that the aperture in the dispenser may simply be a hole. Serrations are not required around the aperture because it will not be necessary to rip the web to detach a sheet. The size of the aperture will depend on the material characteristics of the webs. The important criterion is that a frictional force is present between the web being pulled and the aperture which is sufficient to break the line of weakness or perforations in the web when the force is transmitted across the line of weakness.

Figure 2:
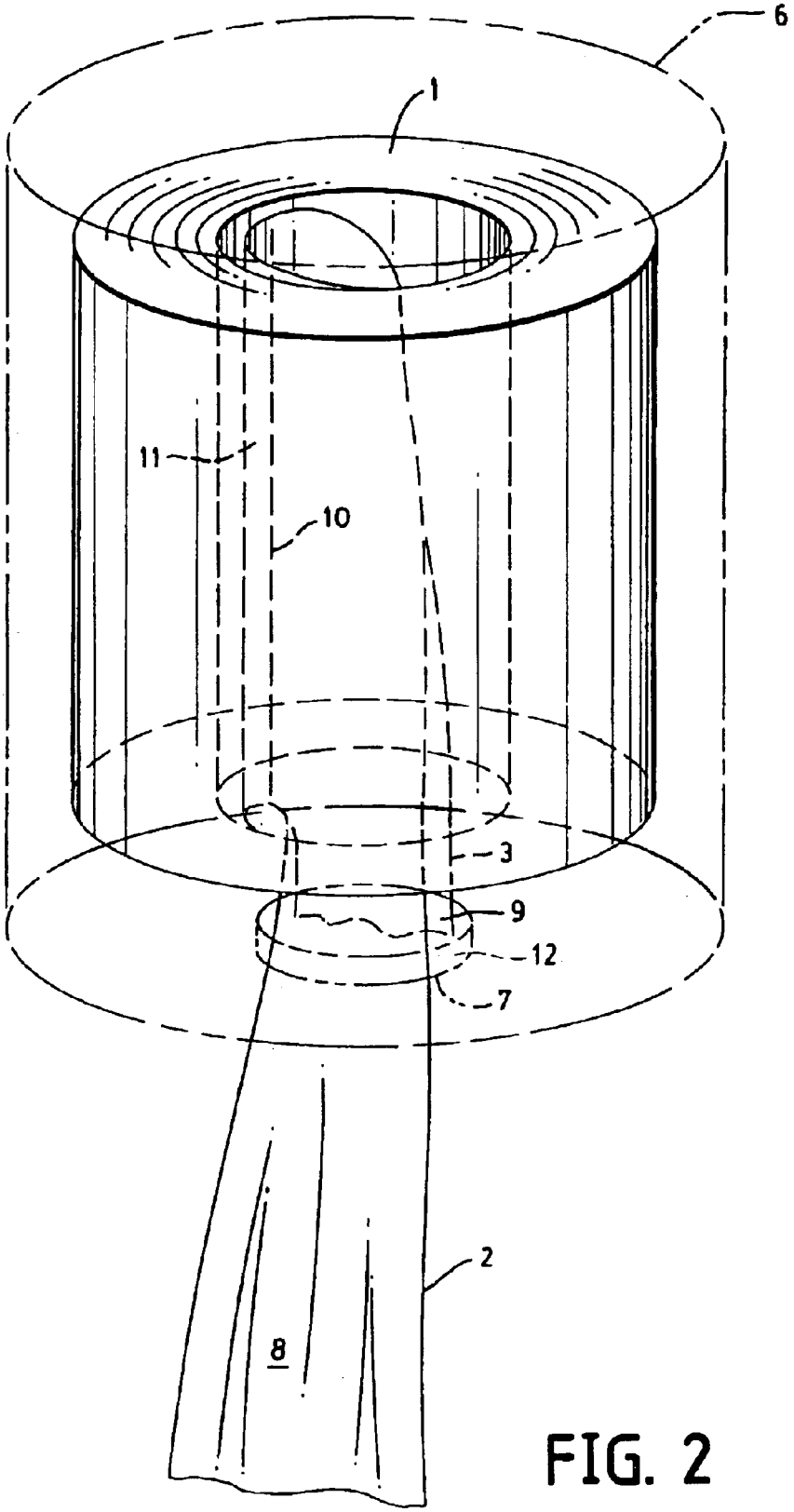
FIG. 2 shows a perspective view of the center-feed roll of FIG. 1 in use in a dispenser.

FIG. 2 shows the center-feed roll 1 in use in a dispenser 6. The dispenser 6 is shown in outline only for simplicity of the figure. The inner and outer webs 2 and 3 are fed through an aperture 7 defined in the dispenser 6. An end sheet 8 of the inner web 2 protrudes from the dispenser 6 further than an end sheet 9 of the outer web 3. When a sheet is to be dispensed, the user will grip the end sheet 8 of the inner web 2 and pull downwards until the friction force between the inner web 2 and a rim 12 of the aperture 7 passes across a line of weakness 10. The end sheet 8 of the inner web 2 will then detach leaving an end of the next sheet 11 of the inner web 2 at the aperture 7. While the inner web 2 is being pulled, the outer web 3 is simultaneously moved downwards by virtue of it being wound with the inner web 2. By the time the end sheet 8 of the inner web 2 has become detached, the end sheet 9 of the outer web 3 will be protruding from the dispenser 6 by a similar amount to the end sheet 8 of the inner web 2 as shown in the diagram. Thus, sheets are presented from alternate webs.

As discussed above, web orientation reversal can result in dispensing problems. Though lightly attaching the inner web to the outer web throughout the entire roll has been known to reduce the incidence of web orientation reversal, such a solution also substantially increases the dispensing forces necessary to obtain successful dispensing, and is likely to cause an increased incidence of streaming. Therefore, heretofore it has been necessary to choose between high incidence of web orientation reversal and high incidence of streaming. With the current invention, it is now possible to substantially reduce the incidence of web orientation reversal without substantially increasing the incidence of streaming. Surprisingly, it has been discovered that attaching the inner and outer webs only near the core of the roll substantially reduces the incidence of web orientation reversal without the substantial increase in streaming. Put another way, both web orientation reversal and streaming are substantially reduced by bonding together a relatively short length of the inner and outer webs nearest the core of the double-wound center-feed roll.

In the practice of the present invention, any of one or more methods known in the art for attaching one web to another such as, for example, mechanical crimping, adhesive bonding, hydrogen bonding, and so forth may be used. Desirably, mechanical crimping devices are used to attach one web to the other.

Conventional mechanical crimp-bonding techniques (i.e., linear edge crimping) utilize pressure loaded, relatively narrow, hardened-metal patterned crimp wheels and smooth, hardened-metal anvil wheels to create autohesive attachment between webs at a bond point (i.e., attachment between the webs without application of adhesives). Crimp-bonding is created when superposed webs are subjected to relatively high pressures at the bond point. Compressed air is typically used to control the amount of pressure applied between the crimping wheels. Conventional crimp-bonding processes utilizing crimping wheels and anvil rolls may be used to produce one or more continuous linear bonds along the length of the webs. These linear bonds may be located at any position across the width of the webs. For example, the one or more crimp lines may be located at or near the center of the webs. As another example, the one or more crimp lines may be located at or near one or both edges of the webs. In a particularly desirable embodiment, two crimp lines are positioned at or near the center of the web.

The strength of the crimp bond is controlled by the pressure applied to the webs by the crimp wheel and the width of the crimp wheel. Higher pressures and wider wheels produce stronger bonds. When mechanically crimping the inner and outer webs, the pressure applied by the crimp wheel desirably ranges from about 300 to about 700 Newtons, more desirably from about 350 to about 650 Newtons, and even more desirably from about 400 to about 600 Newtons. The crimping wheels used may have any width as desired to produce the desired bond strength. As an example, the crimping wheel may have a width ranging from about 2 to about 10 mm. In a particularly desirable embodiment, the crimping wheel has a width of about 4 mm. Such continuous crimping processes are described, for example, in U.S. Pat. No. 5,543,202 to Clark et al. and U.S. Pat. No. 6,245,273 to Wendler, Jr., the entire contents of which are incorporated herein by reference.

In one embodiment, bonding by mechanical crimping can be achieved through coarse knurling on a crimping wheel. The knurling may comprise, for example, a mesh pattern of crossed diagonal lines located at discrete locations about the wheel.

As described above, surprisingly it is not necessary to crimp the inner and outer webs together throughout the entire double-wound roll to substantially eliminate the occurrence of web orientation reversal. Rather, it is sufficient to crimp only a first portion of the inner and outer webs. For example, it has been found that applying pressure between the crimping wheels for the first about 2 meters or less, desirably about 1.5 meters or less, or more desirably about 1.0 meters or less of material at the core of the double-wound roll is sufficient to substantially eliminate the occurrence of web orientation reversal. As another example, the length of the bonded portion of the first and second webs may be from about 1 meter to about 2 meters. Alternatively, the length of the bonded portion of the first and second webs may be about 1% or less, about 0.5% or less, or about 0.25% or less of the entire length of the webs. As another example, the length of the bonded portion of the first and second webs may be from about 0.25% to about 1.0% of the entire length of the webs. Desirably, after the first about 2 meters of material are crimped, the pressure applied to the crimping wheels is reduced to a level at which the crimping wheels will continue to turn, but the inner and outer webs will not be crimped together. Keeping the crimping wheels turning during the entire winding process prevents web tears when crimping pressure is applied again at the start of the next roll. The pressures required to turn the crimping wheels without bonding the webs range from about 50 to about 150 Newtons, desirably from about 75 to about 125 Newtons. Desirably then, the unbonded portion of the webs extends to the outside surface of the roll.

As described above, the present invention is well suited for a variety of double-wound center-feed roll products. The present invention is known to be especially well-suited for uncreped through air dried (UCTAD) paper products. The process used to make UCTAD tissue can be generally characterized as follows. Prior to web formation the paper furnish is contained in a machine chest where optional dry strength additives, dyes or other chemical additives may be incorporated. The paper furnish is delivered by a fan pump into a headbox and through a slice at about 0.1% to about 0.4% consistency onto the horizontal surface of a Fourdrinier wire through which water is withdrawn and web formation takes place. The wire travels around a suction breast roll which aids in water removal and web formation. The wire then typically travels around several guide rolls and a wire turning roll and is fed back to the breast roll. One of these rolls is driven to propel the Fourdrinier wire.

The wet web is formed on the upper surface of the Fourdrinier and transferred to a felt by means of a vacuum pick-up. The felt transports the web to a pressure roll assembly. The felt moves around one pressure roll, a solid rubber roll, and is entrained around guide rolls and rotates back to the vacuum pick-up. Moisture is removed in the nip of the pressure roll and transferred into the felt.

Through-drying provides a relatively noncompressive method of removing water from the web by passing hot air through the web until it is dry. More specifically, the wet-laid web is transferred from the forming fabric or felt to a coarse, highly permeable through-drying fabric and retained on the through-drying fabric until it is dry. The resulting dried web is softer and bulkier than a conventionally-dried uncreped web because fewer bonds are formed and because the web is less compressed. While there is a processing incentive to making an uncreped through-dried product, uncreped through-dried webs are typically stiff and, even if calendered, rough to the touch compared to their creped counterparts. This is partially due to the inherently high stiffness and strength of an uncreped web, but is also in part due to the coarseness of the through-drying fabric onto which the wet web is conformed and dried. The UCTAD material is described in greater detail in U.S. Pat. Nos. 5,048,589 and 5,399,412 both commonly assigned to Kimberly-Clark Corporation, the entire contents of both being incorporated herein by reference.

Some types of paper webs that can be formed as double-wound rolls will be more susceptible to web orientation reversal than other webs. For example, lightweight dry creped materials are particularly prone to web orientation reversal. Although not wishing to be bound by a particular theory, it is believed that a high concentration of "stickies" on the outside surface of creped webs may exacerbate web orientation reversal. "Stickies" are known in the art to be agglomerations of sticky material which originate from treatments introduced to recycled fibers in their former use, such as, for example, magazine binder, envelope adhesive, and so forth.

Lightweight dry creped paper is formed similarly to UCTAD with the following exceptions. After formation of the paper web, the formed web is pressed and transferred to the surface of a rotating drying cylinder, commonly referred to as a Yankee Dryer. The web is removed from the surface of the Yankee at web dryness between about 95% and about 96% using a doctor blade. To assist in removing the web from the dryer surface in a controlled uniform state, a creping adhesive is applied to the Yankee surface using a spray nozzle. As an example, an adhesive mixture often used is an about 70% polyvinyl alcohol and about 30% starch based latex. After creping, the creped paper web is wound into a parent roll of desired size.

The creping process and Yankee drying result in other characteristics of lightweight dry creped paper that may lead to web orientation reversal. For example, web flexibility and/or pliability inherent to lightweight dry creped paper can make the web more likely to fall into the center core of the double-wound roll. As another example, lightweight dry creped paper has greater stretchability than UCTAD paper that allows the web to be wound under greater tension. However, the stretchability allows the paper to retract and collapse into the center core of the double-wound roll. To summarize, the presence of stickies, the pliability of the sheet, the smoothness and the higher stretch associated with the lightweight dry creped paper, all contribute to the occurrence of ply reversal in the lightweight dry creped roll.

As mentioned above, the tensile strength of the lines of weakness is controlled to provide ease of dispensing. The strength of the zones of weakness which can be achieved may depend on the limitations of the manufacturing process. During manufacture of the web, the paper processing machines will require a certain minimum tension in the web to be able to run correctly; the strength of the zones of weakness cannot be less than the required minimum tension otherwise the web will break during manufacture.

The desired strength of the zones of weakness will also depend on the strength of the web or base sheet. A stronger and thicker base sheet will tolerate proportionately lower perforation strengths, yet these strengths are higher in absolute terms. In order to cause the perforations to break, the aperture in the dispenser will need to provide a greater frictional force as the perforation strength is higher. However, because the web itself is stronger, there is less risk of it shredding in the aperture before a sheet becomes detached. Weaker and thinner base sheets will need weaker perforations and relatively lower dispensing forces, but there is a greater risk of the web shredding. Desirably, the perforation strength is less than 20% of the tensile strength of the web, more desirably less than 10% of the tensile strength of the web, and even more desirably less than 5% of the tensile strength of the web.

In the portion of the double-wound roll where the webs are bonded and/or crimped together, the shear strength of the bond must also be overcome to remove a single sheet from the dispenser. For this reason, the shear strength of the bond is desirably relatively low. If the bond between the webs is too strong, it will be difficult to remove a single sheet without causing streaming. To minimize streaming, the strength of the bond between the webs is desirably less than about 20% of the tensile strength of the web, more desirably less than about 10% of the tensile strength of the web, and even more desirably less than about 5% of the tensile strength of the web. Alternatively, the strength of the bond between the webs may be between about 5% and about 20% of the tensile strength of the web. However, it has been shown that greater reduction in ply reversal occurs for greater bond strengths between the webs. To minimize ply reversal, the bond strength is desirably greater than about 200 gm, more desirably greater than about 300 gm, and even more desirably greater than about 400 gm. Alternatively, the bond strength may be between about 200 gm and about 400 gm.

Desirably, the total force required to detach a sheet from the web is less than about 3000 grams. It is possible that a detaching force of this order might cause some webs to shred in the aperture, and therefore a more desirable operational value for the total detaching force is about 800 grams or less. The minimum achievable detaching force will depend on the manufacturing process and the minimum tension required by the machinery. It is considered that there is no minimum detaching strength beneath which the web will not perform satisfactorily in use so long as the detaching strength is not exceeded by the force necessary to wind the roll or the force necessary to pull the web from the center-feed roll.

Standard test procedures known to those skilled in the art can be used to test the total detaching force required to remove an individual sheet from the center-feed roll. For example, an Instron Universal Testing Instrument can be used to simulate a detaching action between two adjacent sheets of the double-wound center-feed roll having offset lines of weakness. For a 200 mm wide roll, the sheets are folded into thirds along the machine direction and placed in the 3 inch (76 mm) jaws of the Instron instrument before the test is begun. The jaws initially have a gap of 102±2 mm, and the top jaw is moved upwards at a constant rate of 250 mm/min away from the bottom jaw until the lines of weakness are broken. Total energy (kg/mm), peak load (g), percentage stretch at peak (%) and total stretch as a percentage (%) can be measured.

The strength of the lines of weakness can also be measured in this way by using a sample in which the webs have not been bonded and/or crimped together. Also, the material tensile strength can be measured in this way by using a sample that does not include a line of weakness. In practice a 50 mm wide sample is tested, and the result multiplied by 4 to obtain the tensile strength for a 200 mm wide roll.

Desirably, the lines of weakness or perforations are manufactured to be as weak as possible such that the frictional force exerted by the aperture may be minimized and the web will break as soon as the frictional force between the web and the aperture is present across the perforations. When one web breaks at or near the aperture, a portion of the next sheet on the other web will already be presented. Even if the perforations and aperture are designed so that the web breaks inside the dispenser or aperture, one web should be supported by the other web (which will be protruding from the dispenser at this time) and will be drawn through the aperture when the other web is pulled.

Therefore, the necessary frictional force and consequently the size of the aperture will depend partly on the strength of the perforations and the strength of the bond between the webs. The greater the detaching force, the more restrictive the aperture that is needed, however this can lead to ripping and creasing of the towel. Therefore for the best performance, the perforations are desirably made as weak as possible such that the aperture can be made to give as little restriction as is necessary to successfully dispense the chosen product. As discussed above and further described in EP 0865247 B1 to King, the size of the aperture will also depend on the physical dimensions of the individual sheets, such as thickness, flexibility and width.

The configuration of the perforations across the web can be varied according to the manufacturing process, the characteristics and dimensions of the webs and the particular application. There are essentially two variables involved: the ratio of the width of the remaining uncut web to the total width of one perforation and one uncut portion (the bond ratio), and the number of perforations per unit width of the line of weakness. Both of these parameters can be adjusted to give the desired detaching strength of the sheet, and will be dependent on the thickness of the web, the strength of the web and the dimensions of the aperture through which the web is dispensed. Desirably, the perforations are configured to achieve a detaching strength of 800 grams or less.

Generally, the wider the perforation, the more consistent the bond ratio will be. When the desired length of each perforation is small, any variation in the perforation length due to the manufacturing process will have a greater effect on the remaining uncut length; when the perforation is longer, the same variations exist, but proportionally the effect on the remaining uncut web is much less, so that the detaching strength is more consistent and reliable. It is also more difficult to cut smaller perforations in some materials, such as thicker materials or those with a number of plies. Desirably, therefore, the perforation width is greater than 1 mm.

Furthermore, the tendency of a web having shorter uncut portions to rip during manufacture is greater compared to a web having the same detaching strength but longer uncut portions. This is because the individual remaining portions of uncut web are weaker, and therefore any variation in the tension across the web during manufacture can cause the end uncut portion to tear, resulting in the web "unzipping" across its width. This is undesirable during manufacture. Consequently, webs with low detaching strengths and smaller uncut portions are more difficult to manufacture.

Conversely, for paper, uncut portions of greater than about 2 mm in length may result in dispensing problems. At an equivalent bond ratio the larger uncut portions mean larger cut portions that can tend to gape. Gaping may result in snagging and creasing of the webs. Additionally, larger uncut portions can tear unpredictably and result in unsightly areas torn from the following sheet.

Desirably the perforation bond ratio is less than about 1:5 (20%). More desirably the perforation bond ratio is about 1:10 (10%) or less. Still more desirably, the perforation bond ratio is about 1:20 (5%) or less. Even more desirably, the perforation bond ratio is about 1:30 (3.33%) or less.

This ratio will clearly be the same as the ratio of the strength of the line of weakness to that of the material itself; if there is a 10% bond ratio, the sheet detaching strength will be 10% of the material tensile strength. However, if the material strength approaches the perforation strength, the risk of the web shredding at the aperture and not detaching into single sheets is greater. Desirably, therefore this ratio is less than about 20%.

Desirably, each web has less than about 15 perforations per 10 cm width of the roll, more desirably less than about 10 perforations per 10 cm and still more desirably less than about 5 perforations per 10 cm.

One desired perforation configuration which the applicants have found to work satisfactorily in practice is a bond ratio of about 20% and a perforation width of about 8 mm, making the uncut web width about 2 mm. However any suitable perforation configuration which will achieve the desired detaching strength is envisioned.

The center-feed roll according to the invention can be manufactured by winding up two webs having lines of weakness such as perforations which have the required offset. This offset may be achieved by feeding each non-perforated web into offset perforators before they are combined to form the roll. Alternatively, the two webs can be brought together first and then fed to a single perforator where they are perforated simultaneously. To achieve the offset, the webs are then separated and one web made to travel a further distance than the other before they are again united and fed into a crimper. This latter method has the advantage that only one perforator is needed, thus simplifying and reducing is the cost of the manufacturing process. After the webs are configured with offset perforations they are fed into a crimper having capability to intermittently lightly bond the two webs together. Thereafter, the webs are wound into a roll.

Figure 3:
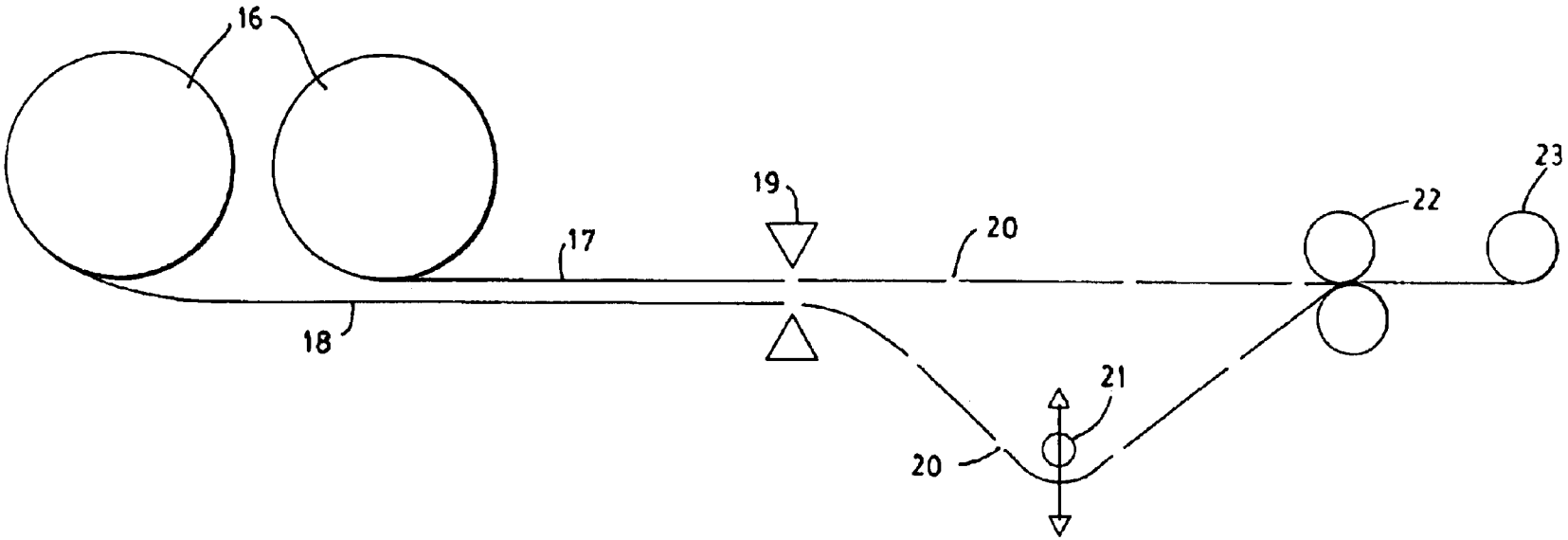
FIG. 3 shows in elevation an apparatus for manufacturing the center-feed roll of the invention.

An apparatus suitable for manufacturing the center-feed roll of the present invention is shown in FIG. 3. Two base rolls 16 on unwinding stands supply inner and outer webs 17 and 18 which are brought together and fed to a single perforator 19 where the perforations 20 are applied to the inner and outer webs 17 and 18 simultaneously. In order to provide the inner and outer webs 17 and 18 with the necessary offset before the center-feed roll is wound, the outer web 18 is made to travel a further path than the inner web 17 by passing the outer web 18 around a roller 21. The position of the roller 21 can be adjusted in a direction perpendicular to the direction of travel of the inner and outer webs 17 and 18 such that the degree of offset can be adjusted for different products. Once the perforations 20 have been offset, the two webs are passed through a crimper 22. As described above, the crimper 22 is capable of being activated and deactivated such that only a portion of the double-wound inner and outer webs 17 and 18 at the inner surface of the double-wound center-feed roll is crimped. After the inner and outer webs 17 and 18 pass through the crimper 22, the inner and outer webs 17 and 18 are wound into a double-wound center-feed roll 23.

TEST PROCEDURES

Dispensing Test:

Double-wound center-feed rolls are tested according to the following protocol. The roll to be tested is placed in a dispenser, noting the orientation of the crimp line if the crimp line in the roll is off-center. Generally, dispensing is improved if the roll is oriented in the dispenser such that the crimp line is as far as possible from the dispensing aperture. Initially, five sheets are removed from the roll. Thereafter, ten sheets are removed one at a time, stopping after every ten dispense to record the results according to the following criteria.

Good Dispense: A good dispense is defined as when the sheet dispensed does not rip or tear.

Streaming: There are various rules for quantifying streaming. If two sheets are dispensed simultaneously (i.e., if the operator is left holding two sheets), then this is counted as one good dispense and one streamed sheet. If one extra sheet is left protruding from the dispenser, then this is not counted as a stream provided the extra sheet can be dispensed satisfactorily. If more than one extra sheet is left protruding from the dispenser, then the number of sheets over and above the normal two is counted as streamed sheets. If a large stream occurs, then the roll is pulled out of the dispenser until the hand pulling the roll touches the floor. At this point the roll is manually separated so as to leave the normal two sheets protruding from the dispenser. The first sheet is counted as a good dispense and the remaining sheets classed as streamed sheets.

Ply Reversal: If ply reversal occurs, the position in the roll is noted and dispensing is continued without attempting to manually correct the reversal.

EXAMPLE 1

Samples of 25 gsm UCTAD double-wound center-feed rolls were produced from recycled fiber according to standard paper making procedures known to those skilled in the art. Products having offset perforations were made having sheet counts of 570, 600, and 630 sheets per roll. Some samples were perforated with 8 mm perforations, while others had 10 mm perforations. The perforations were separated by 2 mm segments of uncut material. Approximately half of the products were crimped for the first 2 meters of the rolls. The remaining products were crimped for the entire length of the rolls. Surprisingly, the equivalent of only 1 roll out of approximately 2000 tested rolls that were partially crimped exhibited any ply reversal. However, in tests for streaming, partially crimped rolls averaged 0.7% streaming with a maximum recorded value of 4.2% streaming. This compares favorably with the fully crimped rolls that averaged 9.5% streaming with maximum recorded value of over 40% streaming.

EXAMPLE 2

Samples of 35 gsm UCTAD double-wound center-feed rolls were produced from both virgin and recycled fiber according to standard paper making procedures known to those skilled in the art. Products having offset perforations were made having sheet counts of 400 sheets per roll. The samples were perforated with 10 mm perforations separated by 2 mm segments of uncut material. Approximately half of the products were crimped for the about the first 1.5 meters of the rolls. The remaining products were crimped for the entire length of the rolls. It was demonstrated at speeds up to 250 meters/minute that crimping of only the first 1.5 meters of product could be achieved. Crimping pressure was 590 Newtons. While not crimping, pressure of 147 Newtons was applied to the crimp wheels to maintain slight contact with the paper and maintain rotation of the crimp wheels.

Ply reversal was not an issue for either the fully crimped or the partially crimped rolls. However, in tests for streaming, partially crimped rolls made from recycled fibers averaged 0.3% streaming while partially crimped rolls made from virgin fibers averaged 0.2% streaming. These compare favorably with the fully crimped rolls made from recycled fibers that averaged 11.6% streaming and fully crimped rolls made from virgin fibers that averaged 26.4% streaming.

While the invention has been described in detail with respect to specific embodiments thereof, it will be apparent to those skilled in the art that various alterations, modifications and other changes may be made without departing from the spirit and scope of the present invention. It is therefore intended that all such modifications, alterations and other changes be encompassed by the claims.

What is claimed is:

1. A double-wound center-feed roll comprising at least two webs having regularly spaced lines of weakness, the lines of weakness of the first web being offset from the lines of weakness of the second web, wherein a first portion of the first and second webs at the center of the roll is bonded to form a bond between the first and second webs, and further wherein a second portion of the first and second webs remains unbonded.

2. The double-wound center-feed roll of claim 1 wherein the length of the first portion is about 1.5 meters.

3. The double-wound center-feed roll of claim 1 wherein the length of the first portion is from about 1 meter to about 2 meters.

4. The double-wound center-feed roll of claim 1 wherein the lines of weakness are defined by perforations.

5. The double-wound center-feed roll of claim 4 wherein the perforation width is greater than about 1 mm.

6. The double-wound center-feed roll of claim 1 wherein the length of the first portion is less than about 1% of the entire length of the webs.

7. The double-wound center-feed roll of claim 1 wherein the attachment strength between the webs in the first portion is less than about 20% of the tensile strength of the webs.

8. The double-wound center-feed roll of claim 1 wherein the attachment strength between the webs in the first portion is greater than about 200 grams.

9. The double-wound center-feed roll of claim 1 wherein each web has less than about 15 perforations per 10 cm width of the roll.

10. The double-wound center-feed roll of claim 1 wherein the offset ratio of the perforations of the first web to those of the second web is less than about 70/30.

11. The double-wound center-feed roll of claim 1 wherein the offset ratio is about 50/50, such that each sheet is presented in an amount equal to that of the previous and the subsequent sheets.

12. The double-wound center-feed roll of claim 1 wherein the web is formed from paper, nonwoven or film.

13. The double-wound center-feed roll of claim 1 wherein the strength of the lines of weakness is less than about 20% of the tensile strength of the webs.

14. The double-wound center-feed roll of claim 1 wherein the bond comprises a crimped bond.

15. The double-wound center-feed roll of claim 1 wherein the second portion of the two webs extends to the outside surface of the roll.

16. A method of making a double-wound center-feed roll comprising the steps of:

a) providing at least a first web and a second web;

b) perforating the first and second webs to form first and second webs having regularly spaced lines of weakness;

c) offsetting the lines of weakness to form first and second webs having regularly spaced offset lines of weakness;

d) simultaneously winding the first and second webs having regularly spaced offset lines of weakness to form a roll;

e) activating a bonder at the start of the formation of the roll wherein a first portion of the first and second webs is bonded to form a bond between the first and second webs at the center of the roll; and f) deactivating the bonder prior to completion of the roll wherein a second portion of the first and second webs remains unbonded.

17. The method of claim 16 wherein the bonder comprises a crimping wheel, and further wherein the crimping wheel remains in contact with the webs during the entire winding of the roll.

18. The method of claim 17 wherein the crimping wheel rotates during the entire winding of the roll.

19. The method of claim 16 wherein the strength of the lines of weakness is less than about 20% of the tensile strength of the webs.

20. The method of claim 16 wherein the second portion of the two webs extends to the outside surface of the roll.

* * * * *